United States Patent [19]

Shelmire, Jr.

[11] 3,975,313

[45] Aug. 17, 1976

[54] SOLID AMPHOTERIC SKIN CLEANSER

[76] Inventor: Jesse Bedford Shelmire, Jr., 4413 Larchmont, Dallas, Tex. 75205

[22] Filed: June 19, 1974

[21] Appl. No.: 480,814

[52] U.S. Cl. ..... 252/542; 252/106; 252/546; 252/DIG. 7; 252/DIG. 16

[51] Int. Cl.[2] ..... C11D 1/84; C11D 3/20

[58] Field of Search ..... 252/106, 546, DIG. 7, 252/DIG. 16, 118, 122, 117, 174, 542; 424/319; 260/534 R, 534 S, 501.11, 501.12, 501.13

[56] References Cited

UNITED STATES PATENTS

| | | | |
|---|---|---|---|
| 3,280,179 | 10/1966 | Ernst | 260/501.12 |
| 3,442,812 | 5/1969 | Barnhurst et al. | 252/142 |
| 3,490,743 | 1/1970 | Schmitz et al. | 252/106 |
| 3,562,167 | 2/1971 | Kamen et al. | 252/121 |
| 3,598,746 | 8/1971 | Kaniecki et al. | 252/122 |
| 3,658,994 | 4/1972 | Kaiser et al. | 424/319 |
| 3,663,459 | 5/1972 | Yoshida et al. | 252/546 |
| 3,766,097 | 10/1973 | Rosmarin | 252/552 |
| 3,822,312 | 7/1974 | Sato et al. | 252/527 |
| 3,903,008 | 9/1975 | Deweever et al. | 252/118 |

FOREIGN PATENTS OR APPLICATIONS

| | | |
|---|---|---|
| 942,194 | 11/1963 | United Kingdom |

*Primary Examiner*—P.E. Willis, Jr.
*Attorney, Agent, or Firm*—Richards, Harris and Medlock

[57] ABSTRACT

A solid amphoteric skin cleanser suited for cleansing human skin is produced by admixing a partially neutralized amphoteric surfactant having at least one basic nitrogen and one or more carboxyl groups within the same molecule and a hexahydric alcohol in the presence of elevated temperatures e.g. 155° C. to 165° C. and agitation until a clear homogeneous composition is formed. The solution is then solidified by cooling.

13 Claims, No Drawings

SOLID AMPHOTERIC SKIN CLEANSER

BACKGROUND OF THE INVENTION

This invention relates to skin cleansers. In another aspect, this invention relates to skin cleansers in bar form. In still another aspect, this invention relates to novel solid amphoteric skin cleansers.

Cleansing compositions in solid form that are intended for use on human skin are commonly called bar soaps, regardless of their chemical composition. In addition to their primary use a skin cleansers, these compositions are used as vehicles to deliver certain chemicals and drugs such as germicides and conditioners to the skin surface.

Most conventional, so-called bar soaps, used as skin cleansers, contain anionic surfactants which render them anionic in nature. These anionic cleansing compositions have certain inherent undesirable properties which limit their effectiveness in cleansing human skin as well as their usefulness as vehicles for desirable additives. For example, when used for the cleansing of human skin, all anionic bar cleansers have a relatively high irritant potential. This was shown by the article Van Scott, E. J. and Lyon J. B., "A Chemical Measure of the Effect of soaps and Detergents on the Skin," J. Invest. Dermat. 31: 199–203 (1953). Specifically, many anionic bar cleansers have limited rinsability which increases their irritant potential. In addition, anionic bar soaps are inherently incompatible with certain useful cosmetics and medicaments such as cationic germicides and conditioners that might otherwise be advantageously incorporated into a solid cleanser intended for use on human skin.

Cleansers containing amphoteric surfactants do not exhibit the undersirable properties inherent in the anionic skin cleansers. Amphoteric surfactants have been used successfully in detergents, shampoos, soaps and wetting agents. Such compositions are, however, liquids at ambient temperatures and attempts to produce solid amphoteric compositions have been unsuccessful. Heretofore, all solid amphoteric cleansing compositions have not contained commercially acceptable attributes, i.e., stability, foaming characteristics, cleansing efficiency and cosmetic appearance.

SUMMARY OF THE INVENTION

According to the invention, a novel, solid amphoteric skin cleanser is provided which comprises a homogeneous solid composition of effective amounts of a hexahydric alcohol and a partially neutralized amphoteric surfactant.

According to a preferred embodiment of the invention, a solid amphoteric skin cleanser is formed by initially admixing a hexahydric alcohol and a partially neutralized amphoteric surfactant in a molar ratio of from about 2.0:1.0 to about 2.0:3.0, respectively; and heating the mixture with agitation to form a clear homogeneous liquid solution. Thereafter, the liquid composition is solidified by cooling to form a clear homogeneous solid amphoteric skin cleanser.

DETAILED DESCRIPTION OF THE INVENTION

The solid amphoteric skin cleansing composition produced in accordance with the subject invention can be formed into conventionally shaped bars which are stable under temperature changes, resistant to aging, and cosmetically acceptable as well as having excellent foaming characteristics and cleansing efficiency. Additionally, the solid amphoteric skin cleansing composition of the subject invention is highly water soluble, easily rinsable and lather producing in hard as well as salt water. The solid amphoteric skin cleansing composition of the subject invention also has been found to reduce eye irritation on contact and to be completely nonsensitizing and non-irritating to the human skin in either its normal or diseased state.

Moreover, the solid amphoteric skin cleansing composition of the instant invention may be used on broken or diseased skin without causing irritation or exacerbation of the disease process and will produce little or no alteration in the human skin acid-base balance or in the structure of the human skin under prolonged contact. Additionally, the solid amphoteric skin cleanser of the subject invention is compatible with certain cationic chemicals and drugs and is relatively neutral in pH.

The amphoteric surfactant used within the scope of the instant invention generally comprises a partially neutralized carboxy acid amphoteric surfactant preferably with a molecular structure having at least one basic nitrogen and at least one carboxyl group. A particularly preferred structure comprises a derivative of an imidazole having a quaternary or quinquenary nitrogen and containing at least two carboxyl groups. A suitable such material can be depicted by the structural formula I below:

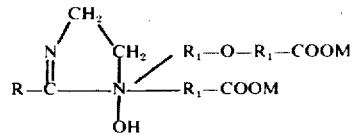

wherein R is an aliphatic hydrocarbon preferably having from about 4 to about 20 carbon atoms but can have any number of carbon atoms as long as the length of the chain does not interfere with the amphoteric properties of the surfactant; $R_1$ is an aliphatic hydrocarbon group having from about 1 to about 4 carbon atoms; and M is either a hydrogen, an alkali metal or a primary, secondary or tertiary amine. Suitable such anhydrous acids are presently solid under the trademark "Miranol" by the Miranol Chemical Company of 279 Coit Street, Irvington, N.J. 07111.

Other suitable carboxy acid amphoteric surfactants which can be used in the scope of this invention are disclosed in U.S. Pat. Nos. 3,528,379; 2,528,380; 2,773,068; 2,781,349 and 3,452,042, which patents are herein incorporated by reference to the subject application.

Another such carboxy acid amphoteric surfactant which can be used in the scope of the subject invention has a general structural formula which can be represented by the structural formula II below:

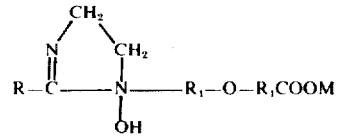

wherein R is an aliphatic hydrocarbon preferably having from about 4 to about 20 carbon atoms but can have any number of carbon atoms as long as the length of the chain does not interfere with the amphoteric properties of the surfactant; $R_1$ is an aliphatic hydrocarbon group having from about 1 to about 4 carbon atoms; and M is a hydrogen, an alkali metal, or a primary, secondary or tertiary amine. Suitable such compounds in aqueous solution are presently sold under the trademark of "Monateric" by Mona Industries, Inc. of 65 E. 23rd, Paterson, N.J. 07524. These aqueous solutions can also be dehydrated by suitable means.

The hexahydric alcohol used within the scope of this invention is generally a straight chain alcohol containing six carbon atoms each of which contains an appended hydroxy group. Suitable hexahydric alcohols can be derived by reduction with hydrogen of either the aldo or the keto monosaccharides having a 6 carbon atom chain. Such hexahydric alcohols include dulcitol, mannitol and sorbitol. Mannitol is a preferred hexahydric alcohol used in the scope of the subject invention.

The solid amphoteric skin cleansers in accordance with the present invention are formed by admixing the amphoteric surfactant with an effective amount of hexahydric alcohol at elevated temperatures with agitation such that a clear homogeneous liquid is produced. The amphoteric surfactant is then partially neutralized by addition of a suitable base. The clear homogeneous liquid obtained will solidify upon cooling to form a solid homogeneous material. It is believed that the thermal mixing process produces a true solution which when cooled, forms a homogeneous solid. The solid thus formed is believed to be at true solid solution of the ingredients.

The neutralization of the carboxy acid amphoteric surfactant can be accomplished during the time that it is admixed with the hexahydric alcohol or subsequent to the heating of the hexahydric alcohol-carboxy acid amphoteric surfactant mixture. Preferably neutralization is accomplished just prior to cooling the heated hexahydric alcohol-carboxy acid amphoteric surfactant mixture. In accordance with this preferred method, a sufficient suitable base is added to the heated composition with agitation such that a 10% aqueous solution of the neutralized composition has a pH from about 5.5 to about 7.5 and preferably about 6.5. Amounts of base used in neutralization are from about 0.3 to about 0.7 and preferably 0.5 molar equivalents of base per mole of carboxy acid amphoteric surfactant.

The bases that can conveniently be used to accomplish neutralization are the alkaline metal hydroxides such as sodium hydroxide or potassium hydroxide; or the amines either primary amines, secondary amines, tertiary amines or mixtures thereof, e.g. triethanol amine, diethyl amine, diisopropanol amine, methyl amine, aniline, butyl amine and the like.

When neutralization is accomplished with an amine, preferred amines are those which are relatively non-volatile at elevated temperatures. Examples of such amines are triethanol amine and diisopropanol amine. The non-volatile amines are preferred because they are known to have less skin irritant potential. Additionally, the use of non-volatile amines allows the composition to be produced at normal atmospheric pressure whereas use of volatile amines may require an apparatus to maintain an elevated atmospheric pressure.

Additionally, within the scope of the instant invention minor effective amounts of additives, for example, cosmetics, medicaments, bacteriacides, hardening agents, perfumes, coloring agents, foam stabilizers and fillers and the like can be utilized in the skin cleanser composition of the subject invention provided such additives are non-deleterious to the composition. Such additives which consist of subsidiary ingredients to the composition of the instant invention are of the type used to improve the appearance or otherwise modify or improve the inherent physical characteristics of the composition. Specific examples of suitable bacteriacides and disinfectants include the quaternary ammonium salts. Specific examples of suitable stabilizing or hardening agents are the solid polyhydric alcohols of high molecular weight, e.g., molecular weights in the range of from about 1,000 to about 15,000 including polyoxyethylene, poloxypropylene, polyoxyethylene-polyoxypropylene block polymers, mixtures thereof, and the like. A particularly suitable solid polyhydric alcohol is the composition sold under the trademark Carbowax 4000 by Union Carbide Corporation.

According to the preferred embodiment, initially 2.0 moles of a hexahydric alcohol is admixed with not less than about 1.0 mole but no more than about 3.0 moles of a carboxy acid amphoteric surfactant and heated to temperatures from about 155°C. to about 165°C. with agitation until a clear homogeneous liquid is obtained. Next, a suitable base is added to this mixture to neutralize the carboxy acid amphoteric surfactant such that a 10% aqueous solution of the mixture shows a pH range of from about 5.5 to about 7.5. The homogeneous liquid is then poured into molds and allowed to cool to ambient temperatures.

It is important that the approximate ratios of the carboxy acid amphoteric surfactant to the hexahydric alcohol as set forth herein be adhered to in order to maintain the desired properties of the resultant composition. Specifically, if the ratio of the amphoteric surfactant to the hexahydric alcohol is too low, the resultant composition will have a rough texture and will be brittle, tending to shatter upon impact. Additionally, the detergent and foaming properties of the composition will also be deteriorated. If, on the other hand, the ratio of the amphoteric surfactant to hexahydric alcohol is too high, the resultant composition will be somewhat unstable at higher room temperatures causing the bar to partially deform and become tacky.

Additionally, if the temperature of the carboxy acid amphoteric surfactant hexahydric alcohol mixture is not sufficiently high, the resulting composition will have a grainy texture. Inversely, if too high a temperature is maintained, certain of the amines utilized to partially neutralize the amphoteric surfactant will tend to volatilize and thus the neutralization will not proceed to a desired point. Additionally, high temperatures may cause decomposition of the amine causing the final composition to have a dark unattractive appearance.

It has been found that solid amphoteric skin cleansers produced in accordance with the invention contain properties which cannot be explained on the basis of the ingredients individually. Specifically, it is well known that hexahydric alcohols in general and mannitol in particular, contain little or no foaming or detergent properties; however, addition of an effective amount of hexahydric alcohol to an amphoteric surfactant under the conditions described herein causes an unaccountable increase in the foaming and detergent qualities of the mixture which are far superior to these properties possessed by the partially neutralized amphoteric surfactant alone.

A solid amphoteric skin cleanser particularly suited for cleansing human skin is produced in accordance with the preferred embodiment by initially admixing 2.0 moles mannitol with not less than about 1.0 mole but not more than 3.0 moles of a carboxy acid amphoteric surfactant consisting of an imidazole derivative have a quaternary or quinuenary nitrogen and preferably containing at least two carboxy groups in a mixing apparatus, for example, a blender, a stirrer, a mixer and the like. The mixture is then heated by energizing a heater which may be any type known in the art, e.g., electric, gas, steam and the like having an operating temperature from about 100°C. The mixture is brought to a temperature of from about 155°C. to about 165°C. During the heating the composition is continually agitated by a mixer or agitator which may be of any type known in the art, e.g., a stirrer, a mechanical shaker, a blender and the like. Next, about 0.5 molar equivalents of a suitable base such as sodium hydroxide is added to the mixture and allowed to dissolve. The temperature is maintained at about 155°C. to 165°C. with agitation until a clear homogeneous solution is obtained. The mixing time will generally be from about 10 to about 30 minutes. The solution is then removed from the heat and poured into suitable molds. Upon cooling to ambient temperatures a solid cleansing composition in bar form is produced.

This invention can more easily be understood from a study of the following examples which are given for illustrative purposes only.

EXAMPLE 1

In this example a solid amphoteric skin cleanser particularly suited for use as a complexion soap was prepared. First 15.0 kilograms of mannitol anhydrous U.S.P. was admixed with 15.0 kilograms of an anhydrous dicarboxylic imidazole derivative with a side chain member having from 6 to 18 carbon atoms sold under the trademark "Miranol $C_2M$ Anhydrous Acid" by Miranol Chemical Company. The temperature of the mixture was then elevated to 155° C. to 165° C. and agitated for about 20 to 30 minutes to obtain a clear homogeneous solution. The temperature of the clear solution was then lowered to 140° C. to 150° C. and 3.0 kilograms of diisopropanol amine was added thereto. Agitation was continued for about 10 to 15 minutes in order to allow the neutralization reaction to go to completion. The mixture was then removed from the heat and poured into molds. The composition upon cooling to ambient temperature was cut into bars.

The resulting composition was suitable for use as a complexion soap and exhibited the following properties: resistant to aging, highly water soluble, easily rinsable, and non-irrating to the skin.

EXAMPLE 2

In this example a solid amphoteric skin cleanser containing a deodorant additive was prepared. First 16.25 kilograms of mannitol anhydrous U.S.P. was melted by heating to about 155°C. Next, 0.60 kilograms of solid sodium hydroxide was added, with agitation, to the molten mannitol and allowed to completely dissolve therein. Next 15.00 kilograms of anhydrous dicarboxylic imidazole derivative with a side chain member having from 6 to 18 carbon atoms, sold under the trademark of "Miranol $C_2M$ Anhydrous Acid" by the Miranol Chemical Company, was added to the sodium hydroxide-mannitol mixture. The temperature was maintained at 155°C. to 165°C. with agitation for about 20 to 30 minutes until a clear homogeneous solution resulted. Next, 0.11 kilograms of Diisobutyl Phenoxyethoxy ethyl di-methylbenzyl ammonium chloride (sold under the tradename "Hyamine 1622" by Rhom and Haas & Co.) and 1.5 kilograms of Polyethylene glycol sold under the trademark Carbowax 4000 by Union Carbide Corporation were added to the clear homogeneous solution with agitation until completely dissolved. The solution was then poured in molds and allowed to cool to ambient temperature. The solidified composition was then cut in bars.

The composition in solid form was found suitable for use as a solid deodorant toilet bar.

This example illustrates the use of an alkali metal hydroxide as a neutralizing agent, which is added to the molten mannitol prior to addition of the amphoteric surfactant. Additionally, this example illustrates that a deodorizing additive may be carried by a composition produced in accordance with the invention without materially affecting desirable properties.

EXAMPLE 3

In this example, a solid amphoteric skin cleanser particularly suited for cleansing human skin was prepared. First, 15.0 kilograms of mannitol anhydrous U.S.P. was added to a mixture of 13.0 kilograms of an anhydrous dicarboxylic imidazole derivative with a side chain member having from 6 to 18 carbon atoms, sold under the trademark "Miranol $C_2M$ Anhydrous Acid" by Miranol Chemical Company, and 2.0 kilograms of a carboxylic imidazole derivative with a side chain member having from 10 to 14 carbon atoms sold under the trademark "Miranol $S_2M$" by the Miranol Chemical Company. The temperature of the mixture was then elevated to 155°C. to 165°C. and agitated until a clear homogeneous solution resulted. The temperature of the solution was then lowered to 140°C. to 150°C. and 3.0 kilograms of triethanol amine was added thereto. Agitation was continued for 10 to 15 minutes until the neutralization reaction was substantially complete. Then 0.16 kilogram of cetyl trimethyl ammonium bromide is added and stirred until a homogeneous solution is again obtained. The solution was then removed from the heat and poured into molds. Upon cooling to ambient temperature the composition solidified and was subsequently cut into bars.

The composition in solid form was found suitable for (1) an antiseptic shaving soap and (2) a solid conditioning shampoo, and exhibited the following properties: resistance to aging, excellent foaming characteristics, highly water soluble, easily rinsable, and highly detergent.

While this invention has been explained in relation to its preferred embodiment, it is to be understood that various modifications thereof will now become apparent to those skilled in the art upon reading the specification and it is intended to cover such modification as fall within the scope of the appended claims.

What is claimed is:

1. A process for manufacturing a solid amphoteric skin cleanser comprising:

a. heating a mixture of: (1) an amphoteric surfactant compound selected from the group consisting of:

I. 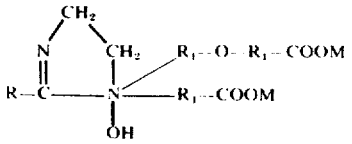

, and

II. 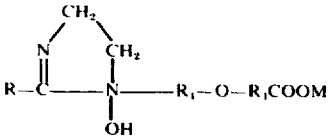

wherein R is an aliphatic hydrocarbon having from about 4 to about 20 carbon atoms; $R_1$ is an aliphatic hydrocarbon having from about 1 to about 4 carbon atoms; and M is selected from hydrogen, an alkali metal, and a primary, secondary or tertiary amine, said amphoteric surfactant being partially neutralized by reaction with from about 0.3 to about 0.7 molar equivalents of base per mole of said amphoteric surfactant, and (2) a hexahydric alcohol selected from the group consisting of ducitol, mannitol, and sorbitol, the molar ratio between said hexahydric alcohol and said amphoteric surfactant being in the range from about 2:1 to about 2:3; said heating occurring at a temperature of from about 155°C to about 165°C to form a homogeneous liquid compositions; and b. cooling said homogeneous liquid to form a solid composition.

2. The product produced by the process of claim 1.

3. The process of claim 1 wherein said hexahydric alcohol is mannitol and said amphoteric surfactant has said formula I.

4. The product produced by the process of claim 3.

5. The process of claim 1 wherein said hexahydric alcohol is mannitol and said amphoteric surfactant has said formula II.

6. The product produced by the process of claim 5.

7. The process of claim 1 wherein said base is selected from a group consisting of alkali metal hydroxides, primary amines, secondary amines and tertiary amines.

8. A process for producing a solid amphoteric skin cleanser comprising:

a. initially forming a mixture of hexahydric alcohol selected from the group consisting of ducitol, mannitol and sorbitol, and an amphoteric surfactant having the formula selected from:

I. 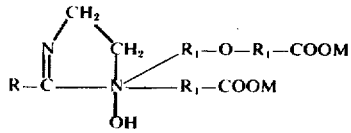

, and

II. 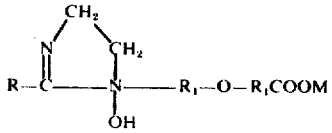

wherein R is an aliphatic hydrocarbon having from about 4 to about 20 carbon atoms; $R_1$ is an aliphatic hydrocarbon having from about 1 to about 4 carbon atoms; and M is selected from hydrogen, alkali metal or primary, secondary or tertiary amines, in molar ratios of said hexahydric alcohol to said amphoteric surfactant in the range of from about 2:1 to about 2:3 respectively;

b. heating said mixture to a temperature in the range of from about 155°C to about 165°C with agitation to form a homogeneous liquid composition;

c. admixing with the resulting homogeneous liquid composition from about 0.3 to about 0.7 molar equivalents of a base, based upon said amphoteric surfactant, said base selected from the group consisting of alkali metal hydroxides, primary amines, secondary amines and tertiary amines; and d. cooling said homogeneous liquid to ambient temperatures.

9. The product produced by the process of claim 8.

10. The process of claim 8 wherein said hexahydric alcohol is mannitol and said amphoteric surfactant has said formula I.

11. The product produced by the process of claim 10.

12. The process of claim 8 wherein said hexahydric alcohol is mannitol and said amphoteric surfactant has said formula II.

13. The product produced by the process of claim 12.

* * * * *